US006485442B2

(12) United States Patent
Batula

(10) Patent No.: US 6,485,442 B2
(45) Date of Patent: Nov. 26, 2002

(54) CRIB MOUNTED BABY SOOTHING DEVICE

(76) Inventor: Antonietta Batula, 7735 W. Fullerton, Elmwood Park, IL (US) 60707

( * ) Notice: Subject to any disclaimer, the term of this patent is extended or adjusted under 35 U.S.C. 154(b) by 0 days.

(21) Appl. No.: 09/735,043

(22) Filed: Dec. 13, 2000

(65) Prior Publication Data

US 2002/0072692 A1 Jun. 13, 2002

(51) Int. Cl.[7] ..... A61H 7/00

(52) U.S. Cl. ..... 601/87; 601/93; 601/108

(58) Field of Search ..... 601/84, 56, 85, 601/87, 89, 93, 108, 134, 136; 180/166; A61H 7/00, 23/00

(56) References Cited

U.S. PATENT DOCUMENTS

| | | | | |
|---|---|---|---|---|
| 3,403,674 A | * | 10/1968 | Alimanestiano | 601/134 |
| 3,552,388 A | * | 1/1971 | Zelenka | 128/55 |
| 4,951,331 A | * | 8/1990 | Pereira | 5/109 |
| 5,016,617 A | * | 5/1991 | Tarlow et al. | 601/101 |

* cited by examiner

*Primary Examiner*—Danton D. DeMille
*Assistant Examiner*—Quang D Thanh
(74) *Attorney, Agent, or Firm*—Goldstein & Lavas, P.C.

(57) ABSTRACT

A crib mounted baby soothing device including a support bracket adjustably secured to the frame of the crib. A massaging hand is coupled with respect to the support bracket. The massaging hand is positioned over a baby laying down within the crib to providing a massaging motion to the back and backside of the baby.

1 Claim, 3 Drawing Sheets

CRIB MOUNTED BABY SOOTHING DEVICE

BACKGROUND OF THE INVENTION

The present invention relates to a crib mounted baby soothing device and more particularly pertains to patting and rubbing a baby's back and bottom when the baby cries or moves.

Providing care to infants and babies is essentially a twenty-four hour a day job. The most difficult task that parents and care-givers have with respect to infants and babies involves keeping their child asleep, or getting their child to fall asleep. Usually, the parent or care-giver will either hold their child while rocking them in a chair or the like. Alternately, the child will be laid down in their crib while the parent or care-giver rubs or pats their back or bottom in order to soothe the child in a restful sleep. Sometimes, this latter task takes a significant amount of time that the parent or care-giver does not have. The parent or care-giver may be required to stay up to all hours of the night sacrificing their sleep in order to soothe their child into a sleeping state. What is needed is a way to soothe the child to sleep or soothe the child that is sleeping restlessly without having to tend to the child to all hours of the night.

The present invention attempts to solve the abovementioned problems by providing a device that will rub or pat a child's back or backside automatically while allowing a parent or care-giver to tend to other things.

The use of infant care devices is known in the prior art. More specifically, infant care devices heretofore devised and utilized for the purpose of providing care to infants are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,649,964 to Berman discloses a battery operated teething ring and bum massaging device for an infant. U.S. Pat. No. 3,952,343 to Wong discloses an automatic baby crib rocker device.

While these devices fulfill their respective, particular objective and requirements, the aforementioned patents do not describe a crib mounted baby soothing device for patting and rubbing a baby's back and bottom when the baby cries or moves.

In this respect, the crib mounted baby soothing device according to the present invention substantially departs from the conventional concepts and designs of the prior art, and in doing so provides an apparatus primarily developed for the purpose of patting and rubbing a baby's back and bottom when the baby cries or moves.

Therefore, it can be appreciated that there exists a continuing need for a new and improved crib mounted baby soothing device which can be used for patting and rubbing a baby's back and bottom when the baby cries or moves. In this regard, the present invention substantially fulfills this need.

SUMMARY OF THE INVENTION

In the view of the foregoing disadvantages inherent in the known types of infant care devices now present in the prior art, the present invention provides an improved crib mounted baby soothing device. As such, the general purpose of the present invention, which will be described subsequently in greater detail, is to provide a new and improved crib mounted baby soothing device which has all the advantages of the prior art and none of the disadvantages.

To attain this, the present invention essentially comprises a support bracket adjustably secured to the frame of the crib. The support bracket includes a telescoping horizontal segment extendable between two of the vertical rails of the frame of the crib. The telescoping horizontal segment includes opposed ends. The support bracket includes a pair of receiving collars secured to the opposed ends of the telescoping horizontal segment. The receiving collars are engagable with the two vertical rails of the frame of the crib whereby the telescoping horizontal segment is suspended between the two vertical rails. A massaging hand is coupled with respect to the support bracket. The massaging hand extends outwardly from the support bracket in an orthogonal relationship. The massaging hand includes a horizontal support extending outwardly from the telescoping horizontal segment of the support bracket. The horizontal support has a vertical handle extending downwardly therefrom. The horizontal support has a free outer end with a motorized ball socket secured thereto. The motorized ball socket has an open outer end. The massaging hand includes a synthetic hand portion coupled with the open outer end of the motorized ball socket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved crib mounted baby soothing device which has all the advantages of the prior art infant care devices and none of the disadvantages.

It is another object of the present invention to provide a new and improved crib mounted baby soothing device which may be easily and efficiently manufactured and marketed.

It is a further object of the present invention to provide a new and improved crib mounted baby soothing device which is of durable and reliable construction.

An even further object of the present invention is to provide a new and improved crib mounted baby soothing device which is susceptible of a low cost of manufacture with regard to both materials and labor, and which accordingly is then susceptible of low prices of sale to the consuming public, thereby making such a crib mounted baby soothing device economically available to the buying public.

Even still another object of the present invention is to provide a new and improved crib mounted baby soothing device for patting and rubbing a baby's back and bottom when the baby cries or moves.

Lastly, it is an object of the present invention to provide a new and improved crib mounted baby soothing device including a support bracket adjustably secured to the frame of the crib. A massaging hand is coupled with respect to the support bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
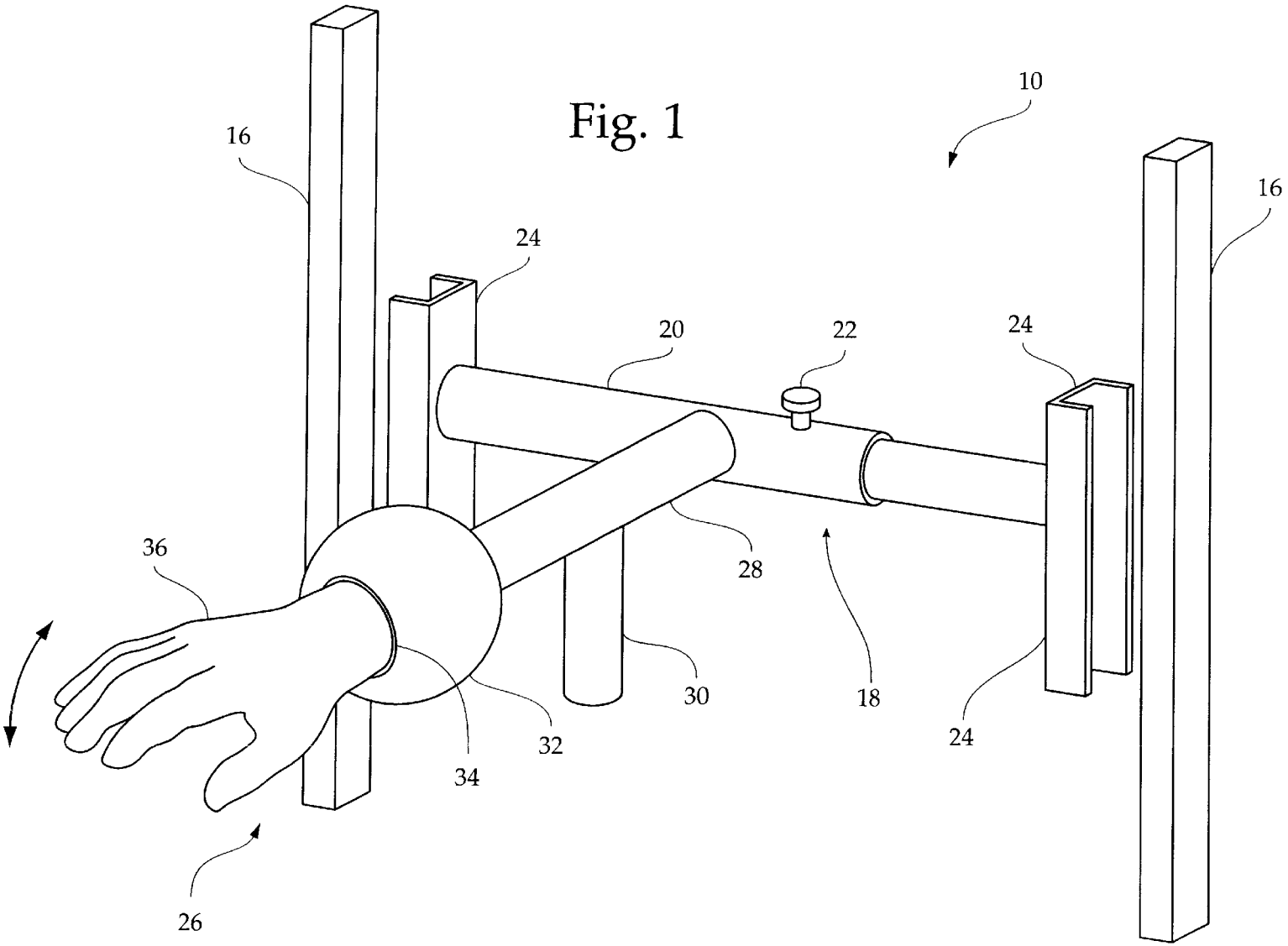
FIG. 1 is a perspective view of the preferred embodiment of the crib mounted baby soothing device constructed in accordance with the principles of the present invention.
Figure 2:
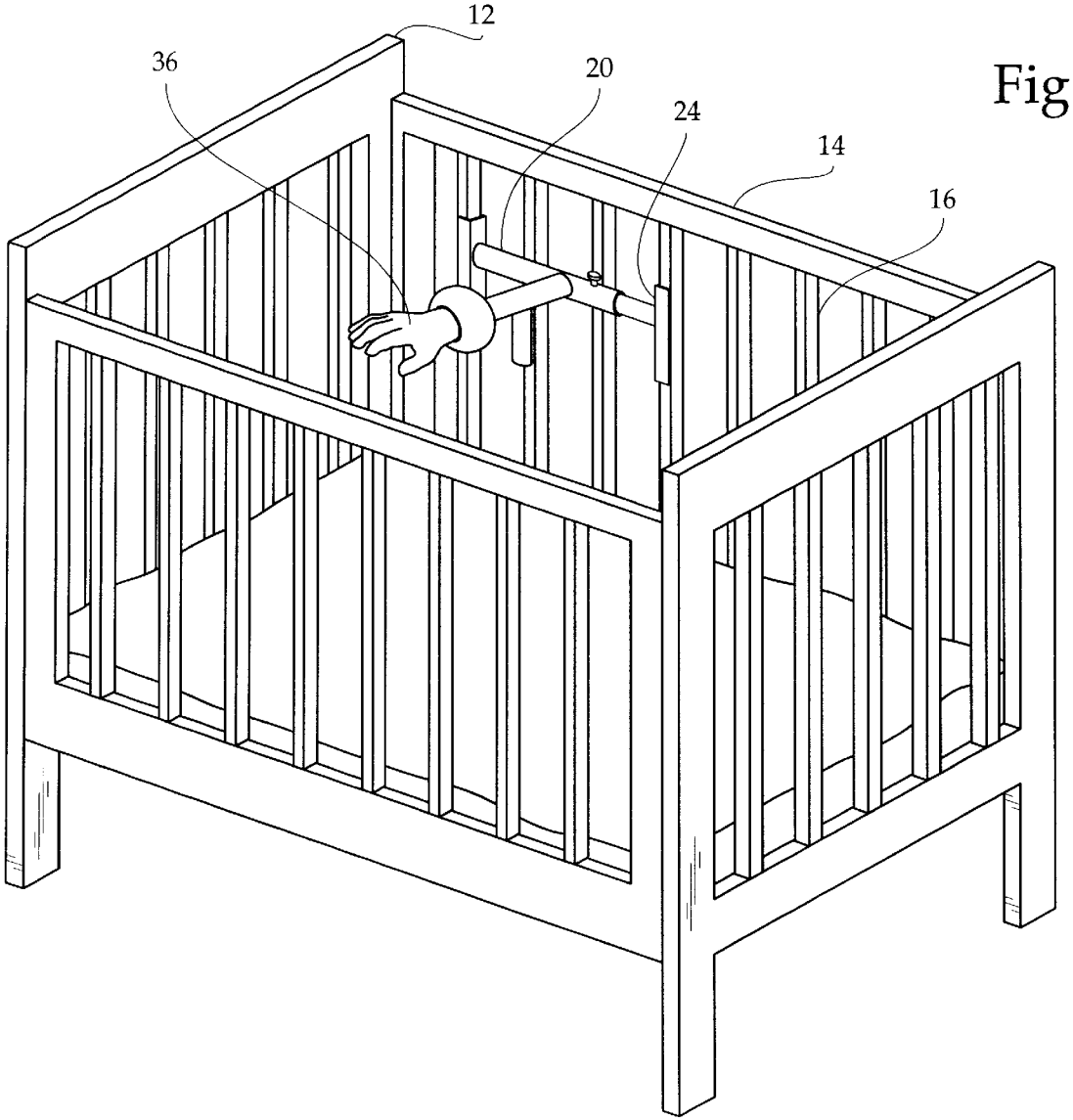
FIG. 2 is a perspective view of the present invention illustrated in place on a crib.
Figure 3:
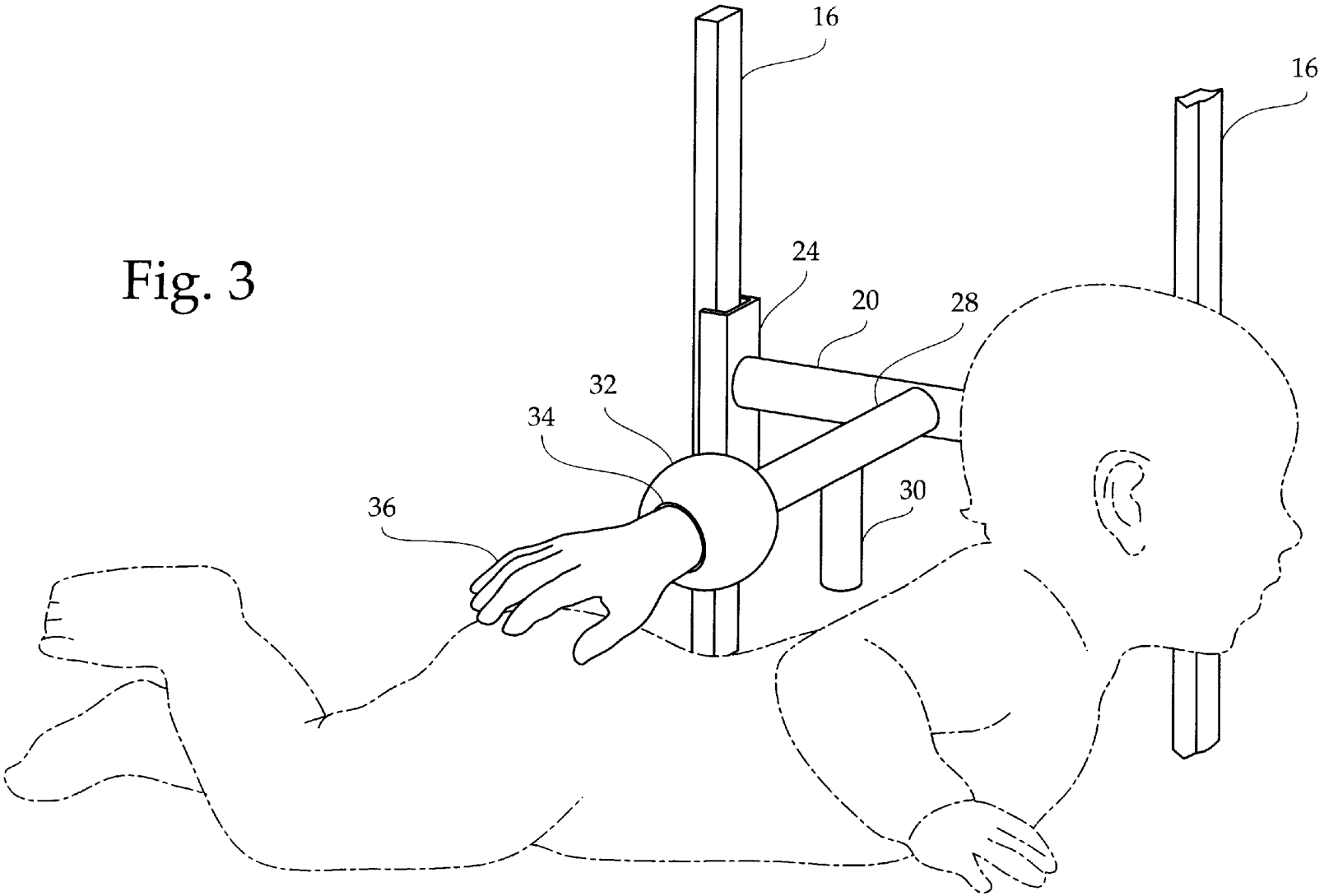
FIG. 3 is a perspective view of the present invention illustrated in use.

With reference now to the drawings, and in particular, to FIGS. 1 through 3 thereof, the preferred embodiment of the new and improved crib mounted baby soothing device embodying the principles and concepts of the present invention and generally designated by the reference number 10 will be described.

Specifically, it will be noted in the various figures that the device relates to a crib mounted baby soothing device for patting and rubbing a baby's back and bottom when the baby cries or moves. In its broadest context, the device consists of a support bracket and a massaging hand. Such components are individually configured and correlated with respect to each other so as to attain the desired objective.

The present invention is designed for use on a standard crib 12. The crib 12 generally includes a frame 14 that is defined by a plurality of vertical rails 16 disposed in a spaced relationship. The vertical rails 16 surround a sleeping area for a child.

The support bracket 18 is adjustably secured to the frame 14 of the crib 12. The support bracket 18 includes a telescoping horizontal segment 20 extendable between two of the vertical rails 16 of the frame 14 of the crib 12. The telescoping horizontal segment 20 is defined by an inner component slidably received within an outer component. Also included is a locking screw 22 that will fix the length of the horizontal segment 20. The telescoping horizontal segment 20 includes opposed ends. The support bracket 18 includes a pair of receiving collars 24 secured to the opposed ends of the telescoping horizontal segment 20. The receiving collars 24 are engagable with the two vertical rails 16 of the frame 14 of the crib 12 whereby the telescoping horizontal segment 20 is suspended between the two vertical rails 16. The receiving collars 24 in the preferred embodiment have a U-shaped cross-section allowing for proper engagement with the square-shaped rails 16 of the crib 12. The receiving collars 24 can be shaped to engage the shape of the rails of the crib no matter the configuration.

The massaging hand 26 is coupled with respect to the support bracket 18. The massaging hand 26 extends outwardly from the support bracket 18 in an orthogonal relationship. The massaging hand 26 includes a horizontal support 28 extending outwardly from the telescoping horizontal segment 20 of the support bracket 18. The horizontal support 28 has a vertical handle 30 extending downwardly therefrom. The horizontal support 28 has a free outer end with a motorized ball socket 32 secured thereto. The motorized ball socket 32 has an open outer end 34. The massaging hand 26 includes a synthetic hand portion 36 coupled with the open outer end 34 of the motorized ball socket 32. The synthetic hand portion 26, in communication with the motorized ball socket 32, will have two ranges of motion. The ranges of motion include an "up and down" motion and a circular motion. These types of motions are merely illustrative of the numerous ranges of motion that could incorporated into the device 10. Additionally, the motorized ball socket 32 could include a sensor that would activate upon movement or sounds generated by the child.

In use, the device 10 is secured to the crib 12 between the rails 16 thereof. The height of the device 10 would depend upon the size of the child. The device 10 should be positioned whereby the synthetic hand portion 36 is positioned in contact with the back or backside of the child.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crib mounted baby soothing device for patting and rubbing a baby's back and bottom when the baby cries or moves, wherein the crib includes a frame having a plurality of vertical rails disposed in a spaced relationship, the soothing device comprising, in combination:

a support bracket adjustably secured to the frame of the crib, the support bracket including a telescoping horizontal segment extendable between two of the vertical rails of the frame of the crib, the telescoping horizontal segment including opposed ends, the support bracket including a pair of receiving collars secured to the opposed ends of the telescoping horizontal segment, the receiving collars being engagable with the two vertical rails of the frame of the crib whereby the telescoping horizontal segment is suspended between the two vertical rails;

a massaging hand coupled with respect to the support bracket, the massaging hand extending outwardly from the support bracket in an orthogonal relationship, the massaging hand including a horizontal support extending outwardly from the telescoping horizontal segment of the support bracket, the horizontal support having a vertical handle extending downwardly therefrom, the horizontal support having a free outer end with a motorized ball socket secured thereto, the motorized ball socket having an open outer end, the massaging hand including a synthetic hand portion coupled with the open outer end of the motorized ball socket.

* * * * *